US006325600B1

(12) United States Patent
Lilie et al.

(10) Patent No.: US 6,325,600 B1
(45) Date of Patent: Dec. 4, 2001

(54) SUCTION ARRANGEMENT IN A RECIPROCATING HERMETIC COMPRESSOR

(75) Inventors: Dietmar Erich Bernhard Lilie; Márcio Luiz Todescat; Fabian Fagotti, all of Joinville (BR)

(73) Assignee: Empresa Brasileira de Compressores S./A - Embraco, Joinville (BR)

( * ) Notice: Subject to any disclaimer, the term of this patent is extended or adjusted under 35 U.S.C. 154(b) by 0 days.

(21) Appl. No.: 09/180,603

(22) PCT Filed: May 7, 1997

(86) PCT No.: PCT/BR97/00016

§ 371 Date: Dec. 11, 1998

§ 102(e) Date: Dec. 11, 1998

(87) PCT Pub. No.: WO97/43546

PCT Pub. Date: Nov. 20, 1997

(30) Foreign Application Priority Data

May 10, 1996 (BR) ..... PI 9601663

(51) Int. Cl.[7] ..... F04B 39/12
(52) U.S. Cl. ..... 417/312; 417/902; 181/403
(58) Field of Search ..... 417/312, 902; 181/403; 62/296

(56) References Cited

U.S. PATENT DOCUMENTS

| | | | | |
|---|---|---|---|---|
| 3,285,504 | * | 11/1966 | Smith | 417/902 |
| 4,242,056 | | 12/1980 | Dyhr | 417/363 |
| 4,371,319 | * | 2/1983 | Murayama et al. | 417/312 |
| 4,793,775 | * | 12/1988 | Peruzzi | 417/312 |
| 5,039,287 | * | 8/1991 | Da Costa | 417/902 |
| 5,451,727 | | 9/1995 | Park | 181/229 |
| 5,507,159 | * | 4/1996 | Cooksey | 417/312 |

FOREIGN PATENT DOCUMENTS

| | | | |
|---|---|---|---|
| 1 189 565 | | 3/1965 | (DE) . |
| 0 325 833 A3 | | 8/1989 | (EP) . |
| 1-244180 | * | 9/1989 | (JP) ..... 417/312 |

OTHER PUBLICATIONS

International Preliminary Examination Report received in respect of International Application No. PCT/BR97/00016 dated Jul. 29, 1998.
Patent Abstracts of Japan, Copy of Abstract in English (1 page): JP 01 244180A, Sep. 28, 1989.
Patent Abstracts of Japan, Copy of Abstract in English (1 page) JP 01 58217785, Dec. 17, 1983.

* cited by examiner

*Primary Examiner*—Andrew M. Dolinar
(74) *Attorney, Agent, or Firm*—Darby & Darby

(57) ABSTRACT

A hermetically sealed shell (21) contains a reciprocating hermetic compressor that has a suction inlet tube (28) for admitting gas into the shell; a suction orifice (24*a*) which is provided at the head of a cylinder (22) disposed inside the shell (21) and which is in fluid communication with the suction inlet tube (28). A suction duct (60) has a first end (61) hermetically coupled to the suction inlet tube (28) and a second end (62) hermetically coupled to the compressor suction orifice inlet (24*a*) and conducts low pressure gas from the suction inlet tube (28) directly to the suction orifice (24*a*) inside of shell (21), the suction duct (60) providing thermal and acoustic energy insulation to the gas being drawn into the compressor and is dimensioned to produce a load loss reduction in the gas flow from the suction inlet tube (28) to the suction orifice (24*a*).

8 Claims, 3 Drawing Sheets

SUCTION ARRANGEMENT IN A RECIPROCATING HERMETIC COMPRESSOR

FIELD OF THE INVENTION

The present invention refers to a suction arrangement in a reciprocating hermetic compressor of the type provided with direct suction between the suction inlet tube and the suction chamber inside its shell.

BACKGROUND OF THE INVENTION

Reciprocating hermetic compressors are generally provided with suction acoustic dampening systems (acoustic filters), which are disposed inside the shell with the function to attenuate the noise generated during the suction of the refrigerant fluid. Such components, however, cause losses both in the refrigerating capacity and in the efficiency of the compressor, resulting from gas overheating and flow restriction. The manufacture of said filters from plastic materials have meant a significant advance regarding their optimization, although a considerable amount of the compressor losses is still due to this component.

In reciprocating compressors, the movement of the piston and the use of suction and discharge valves, which open only during a fraction of the total cycle, produce a pulsing gas flow both in the suction and in the discharge lines. Such flow is one of the causes of noise, which may be transmitted to the environment in two forms: by the excitement of the ressonance frequencies of the inner cavity of the compressor, or of other component of the mechanical assembly, or by the excitement of the ressonance frequencies of the piping of the refrigerant system, i.e., evaporator, condenser and connecting tubes of these components of the compressor refrigerating system. In the first case, the noise is transmitted to the shell, which irradiates it to the external environment.

In order to attenuate the noise generated by the pulsing flow, acoustic dampening systems (acoustic filters) have been used. These systems may be classified as dissipative and reactive systems. The dissipative dampening systems absorb sound energy, but create an undesirable pressure loss. On the other hand, the reactive mufflers tend to reflect part of the sound energy, thereby reducing pressure loss. The dissipative mufflers are more used in discharge dampening systems, where the pulsation is high. The reactive systems are preferred for the suction, since they present less pressure loss. Said pressure loss in the acoustic filters is one of the causes that reduce the efficiency of the compressors, mainly in the suction case, which is more sensible to the pressure loss effects.

Other cause that reduces the efficiency of the compressors, when usual acoustic mufflers are employed, is the overheating of the suctioned gas. During the time interval between the entrance of the gas to the compressor and its admission to the compressor cylinder, the gas temperature is increased, due to heat transfer from the several hot sources existing inside the compressor. The temperature increase causes an increase in the specific volume and consequently a reduction in the refrigerant mass flow. Since the refrigerating capacity of the compressor is directly proportional to the mass flow, reducing said flow results in efficiency loss.

Reducing these negative effects has been achieved with the evolution in the acoustic filter designs.

In prior constructions, the gas coming from the suction line and discharged into the shell passes through the main hot sources inside the compressor, before reaching the filter and being drawn towards the cylinder inside (indirect suction). This gas circulation should promote the cooling of the motor. Because of this and because the filters were usually metallic, the efficiency of the compressor was impaired due to gas overheating.

The requirements for more efficient compressors have led to the development of acoustic dampening systems with more efficient conceptions. The gas, rather than passing through all heated parts inside the compressor, is drawn directly to the inside of the suction filter (U.S. Pat. No. 1,591,239, U.S. Pat. No. 4,242,056). Other technique uses, in the suction piping inside the compressor, nozzles or flared tubes (U.S. Pat. No. 4,486,153), which allow the flow to be directed between the inlet tube and the suction filter. Moreover, such filters began to be manufactured with plastic materials, which have adequate thermal insulating properties. These improvements brought about considerable increases in the efficiency of the refrigerating hermetic compressors. Nevertheless, overheating and load loss due to the use of the suction filter still represent significant amounts in the efficiency losses of the compressors.

In the reciprocating hermetic compressors known in the art, the gas coming from the evaporator enters into the shell and then passes through the suction filter, wherefrom it is drawn to the inside of the cylinder defined in the cylinder block, where it is compressed up to a pressure sufficient to open the discharge valve. Upon being discharged, said gas passes through the discharge valve and discharge filter, leaving the compressor inside and leading towards the condenser of the refrigerating system. In this type of compressor, the discharge filter is always hermetic, i.e., the gas is not released into the shell inside, whereas the suction filter is in fluid communication with said shell inside.

The fact that the compressor has low pressure inside the shell brings about two negative consequences regarding its efficiency. During great part of the compression cycle, the gas inside the cylinder is at a higher pressure than that of the gas inside the shell. This pressure difference generates a gas leakage from the cylinder towards the shell inside, through the gap existing between the piston and the cylinder. This gas is then admitted again in the cylinder through the suction filter, in function of the pressure balance occurring between the shell inside and the cylinder. Such gas is at a higher temperature than that of the gas returning to the evaporator, which causes a reduction in the pumped mass explained above.

This reduction of the pumped mass causes loss of refrigerating capacity and of efficiency, as well (loss due to the leakage through the piston-cylinder gap).

The pressure difference between the cylinder inside and the shell inside also creates a force at the piston top, which is transmitted, through the connecting rod, to the eccentric and bearings. The intensity of this force determines the dimensioning of the piston and bearings: the higher said force, the larger will be the dimensions of said parts and, consequently, the larger will be the dissipation of energy or viscous energy loss in the bearings.

DISCLOSURE OF THE INVENTION

Thus, it is an object of the present invention to provide a suction arrangement in a reciprocating hermetic compressor of the type including a hermetic shell comprising a suction inlet tube for admitting gas into the shell; a suction orifice, which is provided at the head of a cylinder disposed inside the shell and which is in fluid communication with the suction inlet tube, said arrangement comprising a suction means having a first end hermetically coupled to the suction inlet tube and a second end hermetically coupled to the suction orifice, in order to conduct low pressure gas from the suction inlet tube directly to the suction orifice, hermetically in relation to the shell inside, said suction means providing thermal and acoustic energy insulation to the gas being drawn.

In this solution, the gas flow coming from the evaporator of the refrigerating systen is admitted, with no interruption, directly to the cylinder inside, before being compressed in the cylinder and discharged to the condenser through the discharge filter, which is always hermetic in relation to the shell inside.

BRIEF DESCRIPTION OF THE DRAWINGS

The invention will be described below, with reference to the attached drawings, in which.

BEST MODE OF CARRYING OUT THE INVENTION

According to the illustrations, a refrigerating system of the type used in refrigerating appliances usually comprise, connected by adequate piping, a condenser 10, which receives high pressure gas at the high pressure side of a hermetic compressor 20 of the reciprocating type and which sends high pressure gas to a capillar tube 30, where the refrigerant fluid is expanded, communicating with an evaporator 40 which sends low pressure gas to a low pressure side of the hermetic compressor 20.

Figure 1:
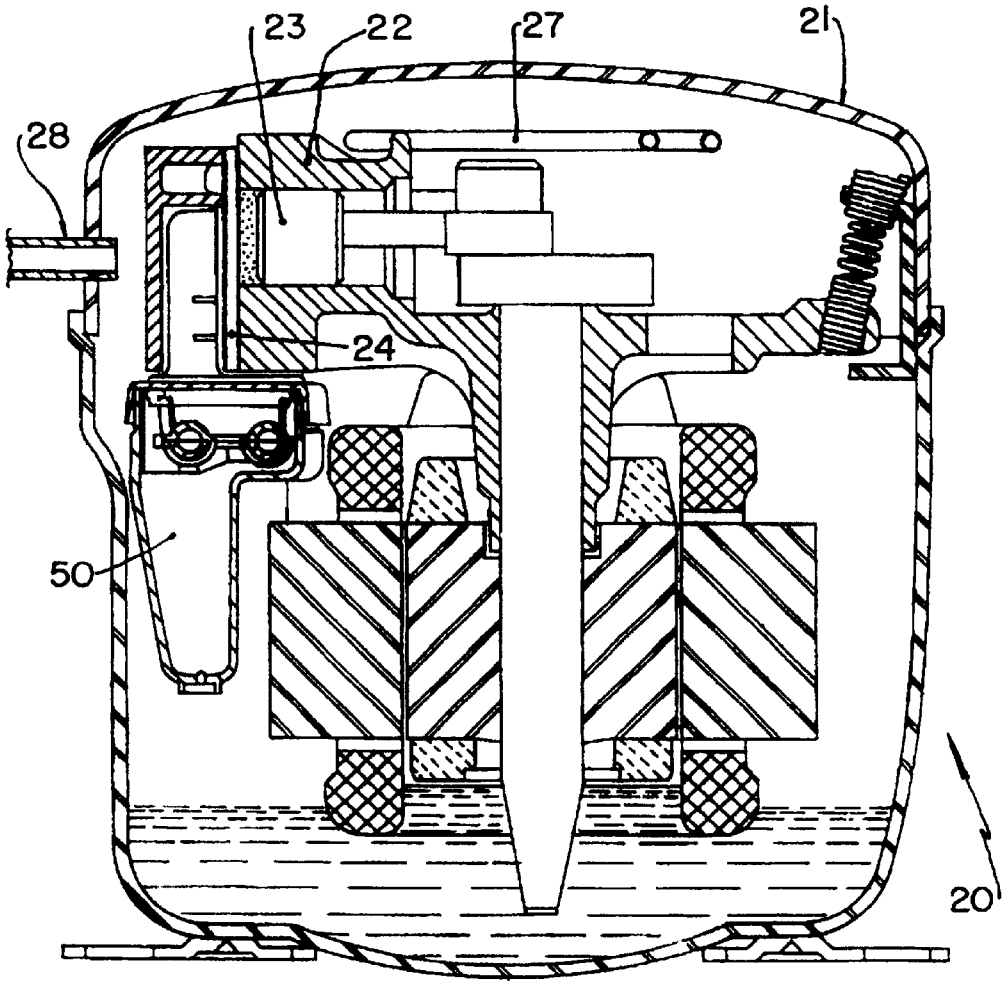
FIG. 1 PRIOR ART
FIG. 1 shows, schematically and in a vertical longitudinal sectional view, a reciprocating hermetic compressor of the type used in refrigerating systems and constructed according to the prior art.
Figure 2:
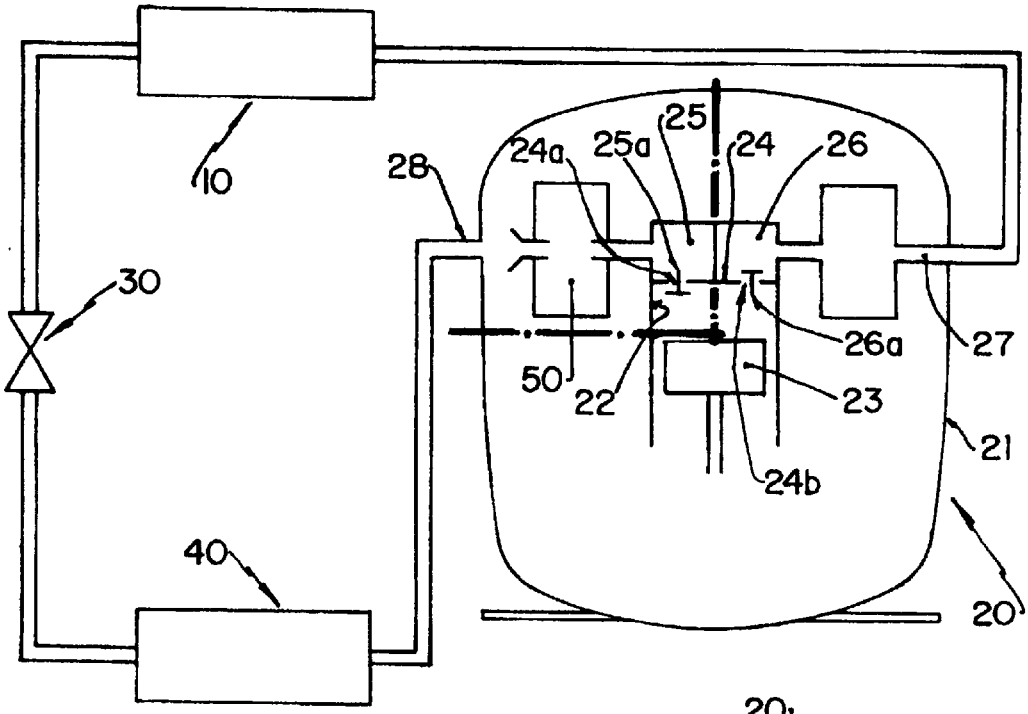
FIG. 2 PRIOR ART
FIG. 2 shows, schematically, a reciprocating hermetic compressor, associated with a refrigerating system according to the prior art.

According to FIG. 1 as shown, the hermetic compressor 20 comprises a hermetic shell 21, inside which is suspended through springs a motor-compressor unit including a cylinder block, which lodges inside a cylinder 22 a piston 23 that reciprocates within said cylinder 22, drawing and compressing the refrigerant gas when driven by the electric motor. Said cylinder 22 has an open end, which is closed by a valve plate 24 affixed to said cylinder block and provided with suction and discharge orifices 24*a*, 24*b*. Said cylinder block further carries a head which is mounted onto said valve plate 24 and which defines internally therewith a suction chamber 25 and a discharge chamber 26, which are maintained in selective fluid communication with cylinder 22, through the respective suction and discharge orifices 24*a*, 24*b*. Said selective communication is defined by opening and closing said suction and discharge orifices by the respective suction and discharge valves 25*a*, 26*a*.

By suction chamber it is meant only the volume of the cylinder head upstream the suction valve 25*a*.

The communication between the high pressure side of the hermetic compressor 20 and the condenser 10 occurs through a discharge tube 27 having an end, which is opened to an orifice provided on the surface of shell 21, communicating said discharge chamber 26 with condenser 10, and an opposite end, which is opened to the discharge chamber 26.

Shell 21 further carries a suction inlet tube 28, mounted to an admission orifice which is provided at shell 21 and opened to the inside of the latter, communicating with a suction tube located externally to shell 21 and coupled to the evaporator 40. In this construction, the gas coming from shell 21 is admitted inside a suction acoustic filter 50 mounted in front of the suction chamber 25, in order to dampen the noise of the gas being drawn into cylinder 22 during the opening of the suction valve 25*a*. This construction has the deficiencies discussed above.

Figure 3:
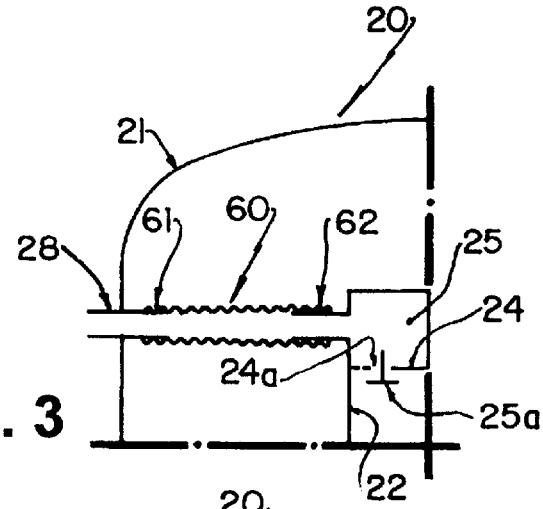
FIG. 3 shows, schematically and in a partial view, a reciprocating hermetic compressor, associated with a refrigerating system according to one constructive form of the present invention.
Figure 4:
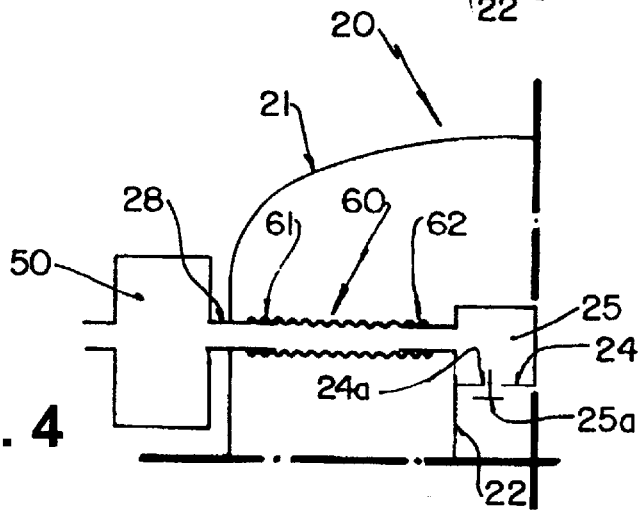
FIG. 4 shows, schematically and in a partial view, a reciprocating hermetic compressor, associated with a refrigerating system according to another constructive form of the present invention.
Figure 5:
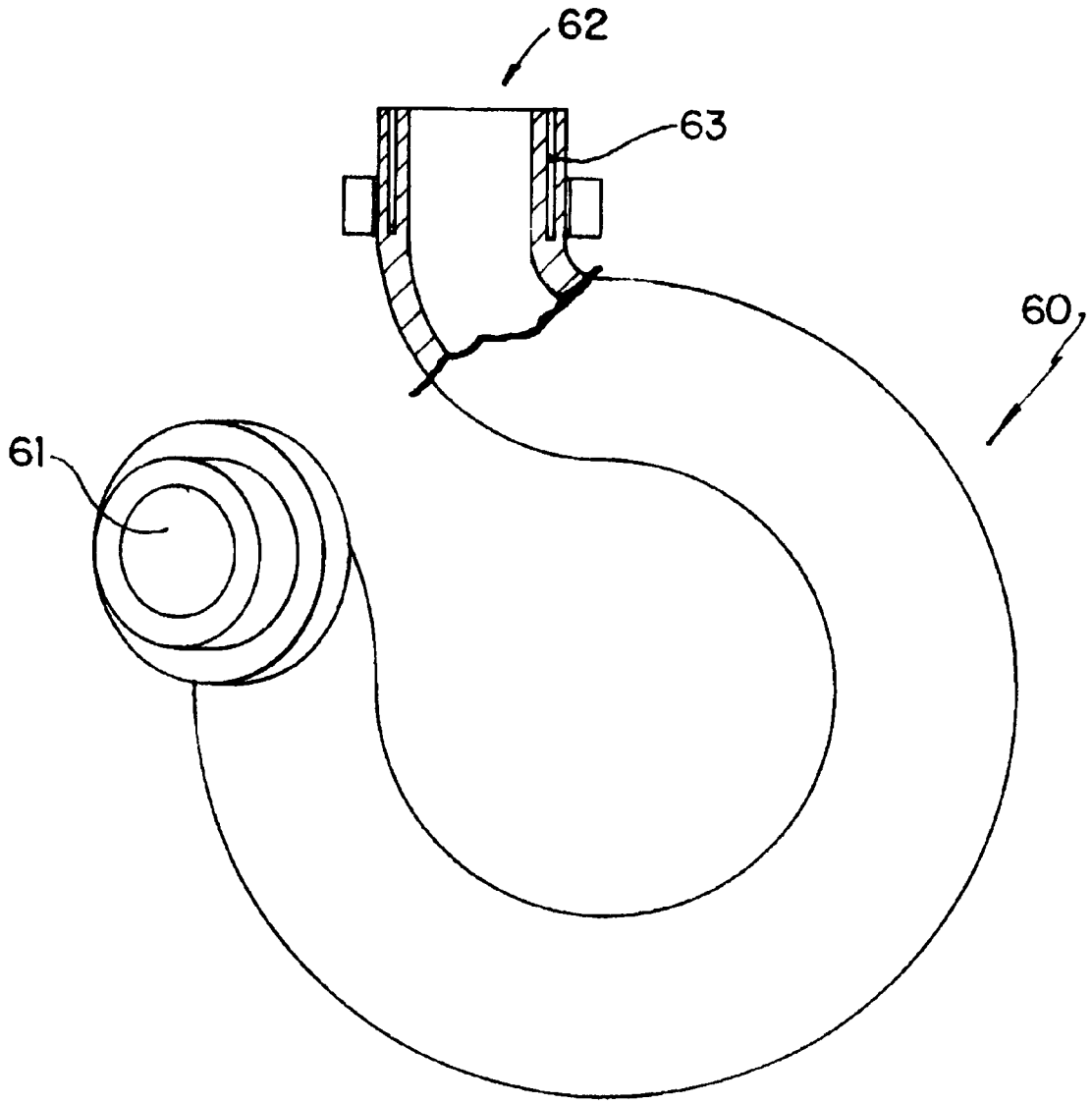
FIG. 5 shows, schematically and in a a front view, a constructive form of the suction means of the present invention.

According to the present invention, as illustrated in FIGS. 3–5, between the evaporator 40 and the inside of suction chamber 25 of the hermetic compressor 20, there is mounted, interconnecting said parts, a suction means 60, which is provided within shell 21 and which comprises, at least on a portion of its length, a suction duct, in flexible material for instance, having a first end 61 coupled to the suction inlet tube 28 and a second end 62 coupled to a gas inlet portion of the suction chamber 25, said suction duct 60 being hermetically affixed to both suction inlet tube 28 and suction chamber 25, so as to conduct, directly and hermetically, low pressure gas from the evaporator 40 to said suction chamber 25, providing thermal and acoustic energy insulation of the gas being drawn. In another constructive option of the present invention, the second end 62 of the suction duct 60 communicates the gas being drawn directly to cylinder 22, for example with said second end 62 being hermetically and directly coupled to the suction orifice 24*a*.

According to the present invention, the hermetic compressor 20 no longer has the suction acoustic filter 50 within shell 21. In a constructive option as illustrated in FIG. 4, the suction acoustic filter 50 is mounted upstream the suction inlet tube 28. Mounting the filter externally to shell 21 allows filters with higher volume and tubes with larger diameters to be used, while still providing the same acoustic dampening effect with less pressure loss. Since the refrigerating capacity is proportional to the suction pressure, the less said loss, the higher will be the compressor efficiency. This filter arrangement prevents the gas, while passing through the inside of said filter, from being unduly heated as it occurs in the prior art construction, although the noise levels generated by an assembly mounted as shown in FIG. 3 are very similar to those produced by the assemblies mounted according to the prior art.

According to the present invention, the suction duct 60 is designed so as to be produced as a continuous tubular duct, which is constructed, in order to avoid interruption of the gas flow being drawn, in an adequate material which causes minimum noise and vibration transmission to shell 21 and which further avoids gas overheating during the admission thereof. In order to have these qualities, the present suction duct 60 is obtained with a construction that offers high resistance to heat transmission, such as for example the constructions using a material with low thermal conductivity characteristic (poor thermal conductors) which also have good acoustic dampening characteristics.

Since the gas which is drawn does not have any connection with the shell inside, it is impossible that said gas excites the ressonances inside the cavity.

Since the pulsation in the suction is of low energy, there is no significant excitement of the external piping to the compressor.

Though not illustrated, other constructions for the suction duct are possible, such as a duct formed by suction duct portions connected to each other in a sealing condition. In any one of the solutions, the suction conducting means should be located so as to operate with an extension of the suction piping, connecting the shell 21 to the evaporator 40, allowing a fluid communication, without interruption between the suction inlet tube 28 and the cylinder 22 of the present compressor.

The requirement of suction piping flexibility is due to the relative movement existing between the mechanical assembly and the shell 21, since the mounting between said parts is made through flexible springs. The flexibility will prevent said piping from being broken during the normal operation of the compressor or during transportation and handling.

The suction duct 60 is further dimensioned in order to minimize the noise generated by the pulsing flow resulting from the excitement of both the suction line piping and the evaporator.

Another characteristic of the dimensioning of the suction duct 60 is its larger diameter in relation to the diameter of the piping upstream the suction inlet tube 28. The diameter of the suction duct 60 is determined to cause a load loss reduction in the gas flow coming from the suction inlet tube 28 and, consequently is led to the suction chamber 25 or also directly to the suction orifice 24*a*.

Due to the characteristics of the gas flow, smaller length and larger diameter of the suction duct 60, there will be less pressure loss in the filter, if used, in relation to the pressure loss existing in the suction filter of the art.

Using the suction duct 60 causes a reduction of the path made by the gas inside the shell, previously to being admitted into the cylinder. By reducing the path, the overheating effect of the gas being drawn is smaller, which increases the refrigerating capacity and efficiency.

In a constructive option of the present invention for the suction means 60, as illustrated in FIG. 5, said means is in the form of a loop tube, which is "U" shaped with rounded sides and internally provided with or incorporating (for example by material injection) at least one spring element 63 which constantly mantains said tube in a condition of structural stability, in order to prevent it from collapsing when submitted to pressure differences, such as during the compressor operation.

Due to the suction tightness, the pressure inside shell 21 is higher than the suction pressure and results from the gas leakage through the gap existing between the piston 23 and the cylinder 22. This leakage increases the pressure inside the shell 21 to a pressure value intermediate between the suction and discharge pressures, usually close to a medium pressure value between the compression start pressure and compression end pressure.

The pressure increase inside the shell allows the compressor to start each new operation, working with less load and therefore requiring a low torque from the motor during the operation thereof. During the suction and the compression start, the inside of shell 21 is at a pressure which is higher than that of the inside of cylinder 22, which makes the gas leak into the latter. From the moment in which the compression pressure in cylinder 22 is higher than that inside the shell 21, which occurs till the end of the discharge, the gas leakage inverts its direction, traveling from the inside of cylinder 22 to the inside of the shell 21. Due to the characteristics of the phenomenum, the leakage towards the shell inside exceeds the other leakage direction, till reaching a medium balance pressure inside the shell 21. In this situation, the leakage is null, if integrated in time, which consequently causes a reduction in the losses due to leakage between the piston 23 and cylinder 22.

With the solution of the present invention, since the pressure inside the shell 21 is intermediate between the compression start pressure and the compression end pressure, the pressure difference actuating over the head of the piston 23 is lower than that observed in the prior art compressors. Since the force transmitted to the bearings is smaller than that observed in the constructions of the prior art compressors, there is a condition of less loading for the operation of the bearings, which increases their reliability. Another advantage that comes from less force transmitted is the reduction of the mechanical losses caused by viscous attrition of the bearings. Another important advantage caused by the smaller difference over the piston is the lower deformation of the mechanism throughout the cycle. This lower deformation results in a reduction of dead volume and consequently higher refrigerating capacity, due to less wear reduction of the parts of this mechanism and cost reduction of the components, since their rigidity may be reduced to the same levels of the actual deformations, making possible to use less noble materials.

What is claimed is:

1. A suction arrangement in a reciprocating hermetic compressor comprising:

a hermetic shell housing a compressor;

a hermetic discharge from the compressor;

a suction inlet tube for admitting gas into the shell;

a suction orifice at the head of a compressor cylinder disposed inside the shell;

a suction tube within said shell having a first end hermetically coupled to the suction inlet tube and a second end hermetically coupled to the suction orifice to conduct low pressure gas from the suction inlet tube directly to the suction orifice, hermetically in relation to the inside of the shell, said suction tube being of a construction to provide high resistance to heat transmitted and providing acoustic energy insulation to the gas being drawn and dimensioned to reduce the load loss of the gas flow arriving at the suction inlet tube and of a construction to resist collapse due to the pressure differential between the interior of said shell and in said suction tube, at least a part of said tube being flexible.

2. A suction arrangement, as in claim 1, wherein the flexible part of said tube is of a material having low thermal conductivity.

3. A suction arrangement as in claim 1 wherein said suction tube is dimensioned to have a larger diameter in relation to the diameter of a piping upstream of said suction inlet tube.

4. A suction arrangement, as in claim 3, wherein said suction tube is formed so that the gas flow being drawn is not interrupted between said suction inlet tube and said suction orifice.

5. A suction arrangement, as in claim 4, wherein the second end of said suction tube is hermetically and directly coupled to a suction chamber associated with the compressor cylinder.

6. A suction arrangement as in claim 1, further comprising a suction acoustic filter mounted upstream of said suction inlet tube.

7. A suction arrangement as claimed in claim 1 wherein said flexible part of said suction tube includes a spring.

8. A suction arrangement for a reciprocating compressor comprising:

a hermetic shell containing the compressor;

a suction inlet tube for admitting gas into said shell;

a suction orifice at the head of a compressor cylinder disposed inside the shell and which is in fluid communication with the suction inlet tube;

a suction means having at least on part of its extension inside of said shell a flexible construction having low thermal conductivity and high resistance to heat transmission, and having a first end hermetically coupled to said suction inlet tube and a second end hermetically coupled to said suction orifice to hermetically conduct low pressure gas inside of the shell from said suction inlet tube directly to said suction orifice;

said suction means providing thermal and acoustic energy insulation to the gas being drawn, said suction means dimensioned to have a larger diameter in relation to the diameter of a piping upstream of said suction inlet tube to reduce the load loss of the gas flow arriving at said suction inlet tube;

wherein said suction means is formed so that the gas flow being drawn is not interrupted between said suction inlet tube and said suction orifice;

the second end of said suction means is hermetically and directly coupled to said suction chamber; and said suction means is in the form of a loop type tube, which is "U" shaped and with rounded sides, and which is internally provided with at least one spring element which constantly maintains a condition of structural stability to said tube.

* * * * *

UNITED STATES PATENT AND TRADEMARK OFFICE

CERTIFICATE OF CORRECTION

PATENT NO. : 6,325,600 B1 
DATED : December 4, 2001
INVENTOR(S) : Dietmar Erich Bernhard Lilie, Marcio Luiz Todescat and Fabian Fagotti It is certified that error appears in the above-identified patent and that said Letters Patent is hereby corrected as shown below:

Title page,
Please change Item [86], § 371 Date: "Dec, 11, 1998" to -- Dec. 10, 1998 --
and change § 102(e) Date: "Dec. 11, 1998" to -- Dec. 10, 1998 --.

Signed and Sealed this

Twenty-first Day of January, 2003

JAMES E. ROGAN
*Director of the United States Patent and Trademark Office*